US008316769B2

(12) United States Patent
Wilson

(10) Patent No.: US 8,316,769 B2
(45) Date of Patent: Nov. 27, 2012

(54) SINGLE PIECE NON-LETHAL PROJECTILE

(75) Inventor: Chris Wilson, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 185 days.

(21) Appl. No.: 12/496,284

(22) Filed: Jul. 1, 2009

(65) Prior Publication Data

US 2012/0210903 A1 Aug. 23, 2012

Related U.S. Application Data

(60) Provisional application No. 61/077,644, filed on Jul. 2, 2008.

(51) Int. Cl.
*F42B 8/02* (2006.01)

(52) U.S. Cl. ..... 102/444; 102/447; 102/469; 102/439

(58) Field of Classification Search ..... 102/444, 102/469, 470, 498, 502, 529, 439, 447
See application file for complete search history.

(56) References Cited

U.S. PATENT DOCUMENTS

| | | | |
|---|---|---|---|
| 228,494 | A | 6/1880 | Valentine |
| 1,526,701 | A | 2/1925 | Fahrenwald |
| 2,112,758 | A | 3/1938 | Blacker |
| 3,326,133 | A | 6/1967 | Stadler et al. |
| 3,650,213 | A | 3/1972 | Abbott et al. |
| 3,714,896 | A | 2/1973 | Young |
| 3,732,821 | A | 5/1973 | Royer |
| 3,791,303 | A | 2/1974 | Sweeney et al. |
| 3,865,038 | A | 2/1975 | Barr |
| 4,164,903 | A | 8/1979 | Bouza |
| 4,208,968 | A | 6/1980 | Hubsch et al. |
| 4,603,637 | A | 8/1986 | Snide et al. |
| 5,009,164 | A | 4/1991 | Grinberg |
| 5,035,183 | A | 7/1991 | Luxton |
| 5,086,703 | A | 2/1992 | Klein |
| 5,225,628 | A | 7/1993 | Heiny |
| 5,237,930 | A | 8/1993 | Bélanger et al. |
| 5,239,928 | A | 8/1993 | Ricci |

(Continued)

FOREIGN PATENT DOCUMENTS

| | | |
|---|---|---|
| WO | WO 83/00213 | 1/1983 |

OTHER PUBLICATIONS

Ebied, Amer, MESc. Candidate, "*Development of Less Lethal Ammunitions for Peace Keeping.*" The University of Western Ontario, Macromolecular Engineering Research Center (MERC), Pinetree Police Research, 27 pages. Available from http://www.foxlabs.net/powerpoint/AE-LessLethal.pdf. Downloaded Oct. 26, 2006. Material not dated.

(Continued)

*Primary Examiner* — James Bergin
(74) *Attorney, Agent, or Firm* — Kane Kessler, P.C.; Paul E. Szabo

(57) ABSTRACT

A reloadable training munition having a reusable shell base having a propulsion system reload inserted into a hollow cavity of the shell base and a reusable single piece projectile inserted into the shell base, the projectile having a hollow body portion, a driving band adjacent the body portion, and a nose portion adjacent the driving band having void spaces for controlling both density and mass properties of the nose portion.

10 Claims, 5 Drawing Sheets

U.S. PATENT DOCUMENTS

| | | | | |
|---|---|---|---|---|
| 5,259,319 | A * | 11/1993 | Dravecky et al. | 102/447 |
| 5,402,729 | A | 4/1995 | Richert | |
| 5,665,808 | A | 9/1997 | Bilsbury et al. | |
| 5,691,501 | A | 11/1997 | Gilbert | |
| 5,936,190 | A | 8/1999 | Buzick | |
| 6,041,712 | A * | 3/2000 | Lyon | 102/439 |
| 6,186,072 | B1 | 2/2001 | Hickerson, Jr. et al. | |
| 6,230,630 | B1 | 5/2001 | Gibson et al. | |
| 6,439,123 | B1 | 8/2002 | Dionne et al. | |
| 6,494,069 | B1 | 12/2002 | Ireblad et al. | |
| 6,543,365 | B1 | 4/2003 | Vasel et al. | |
| 6,615,739 | B2 | 9/2003 | Gibson et al. | |
| 6,832,557 | B2 * | 12/2004 | Torsten | 102/439 |
| 6,990,905 | B1 | 1/2006 | Manole et al. | |
| 7,086,337 | B2 | 8/2006 | Klein | |
| 7,089,863 | B1 | 8/2006 | Dindl | |
| 7,143,699 | B2 | 12/2006 | Brock et al. | |
| 7,173,540 | B2 | 2/2007 | Daigle et al. | |
| 7,207,276 | B1 | 4/2007 | Dindl | |
| 7,228,802 | B2 | 6/2007 | Montefusco | |
| 7,287,475 | B2 * | 10/2007 | Brunn | 102/444 |
| 7,337,725 | B2 | 3/2008 | Queiroz de Aguiar | |
| 7,350,465 | B2 | 4/2008 | Keegstra et al. | |
| 7,503,260 | B2 * | 3/2009 | Kapeles | 102/502 |
| 2004/0069177 | A1 | 4/2004 | Klein | |
| 2005/0268808 | A1 * | 12/2005 | Werner | 102/470 |
| 2006/0225600 | A1 | 10/2006 | Skellern et al. | |
| 2007/0151473 | A1 | 7/2007 | Brunn | |
| 2007/0234891 | A1 | 10/2007 | Puskas et al. | |

OTHER PUBLICATIONS

International Search Report and Written Opinion for Application No. PCT/US2008/061329; date mailed Dec. 12, 2008; search and opinion completed Dec. 4, 2008; 6 pages.

International Search Report and Written Opinion for Application No. PCT/US2008/062177; dated mailed Aug. 14, 2008; search and opinion completed Aug. 8, 2008; 8 pages.

U.S. Patent & Trademark Office action mailed Apr. 18, 2008, corresponding to U.S. Appl. No. 11/482,280.

U.S. Patent & Trademark Office Action mailed Dec. 21, 2007, corresponding to U.S. Appl. No. 11/482,280.

U.S. Patent & Trademark Office Action mailed Jul. 24, 2007, corresponding to U.S. Appl. No. 11/482,280.

U.S. Patent & Trademark Office Action mailed Jun. 30, 2008, corresponding to U.S. Appl. No. 11/454,347.

U.S. Patent & Trademark Office Action mailed Nov. 13, 2008, corresponding to U.S. Appl. No. 11/454,347.

U.S. Patent & Trademark Office Action mailed Mar. 19, 2009, corresponding to U.S. Appl. No. 11/454,347.

U.S. Patent & Trademark Office Action mailed Aug. 6, 2009, corresponding to U.S. Appl. No. 11/454,347.

International Search Report and Written Opinion for International Application No. PCT/US09/49439, mailed Sep. 9, 2009, 8 pages.

* cited by examiner

SINGLE PIECE NON-LETHAL PROJECTILE

CROSS-REFERENCE TO RELATED APPLICATION(S)

This application claims priority to U.S. Provisional Application Ser. No. 61/077,644 filed Jul. 2, 2008.

BACKGROUND OF THE INVENTION

The present invention relates generally to the field of less lethal munitions and, more particularly to a single piece non-lethal projectile for a training version of the less lethal munition.

Less lethal munitions utilized by law enforcement and military forces requires the need to regularly train in the use of these munitions to achieve and maintain proficiency in their deployment. For example, less lethal impact munitions which impart blunt energy to redirect, control, or incapacitate aggressive human targets, depend on accurate shot placement to achieve the desired outcome while minimizing the risk of serious injury. As with any munition fired from a firearm or launcher, accurate and consistent shot placement is only achieved through repetitive training with the actual munitions or realistic training variance.

With the increased use of impact munitions by law enforcement and military forces, as well as the increased numbers of those forces, there is a need for a cost-effective training munition that matches the performance of the actual munition while allowing the user to easily reload and re-use the training munition in the field. One way to decrease the cost of training munition is to design the projectile to be re-used multiple times. This is best accomplished by fabricating the projectile from a high impact polymer material that will withstand repeated firings and impacts without shattering. The cost is further reduced if the projectile can be molded as a single piece in high volume.

Various types of non-lethal munitions have been marketed and sold that have projectiles consisting of multiple components of different densities. This is done to allow tougher, heavier materials to be used on the parts of the projectile that must engage the barrel riffling, and to control the projectile center of gravity. To minimize the risk of injury due to blunt impact, the nose materials used in non-lethal projectiles are typically lower density rubber or foam materials which will deform upon impact with the target. A higher density base and a lower density nose combination are desirable for maximizing the gyroscopic stability and mask properties of a spin-stabilized projectile. Other training and reload kits have been marketed and sold that involve reloading munition projectiles into reloaded shell bases. This results in performance approximating the actual munition trajectory, but only minor cost savings due to the single-use projectile.

Consequently, a need exists for an inexpensive, single piece, reusable projectile that accurately reproduces the aerodynamic, flight stability and mass properties of current non-lethal projectiles, thereby producing an accurate representation of a non-lethal projectile trajectory for training purposes.

SUMMARY OF THE INVENTION

The present invention is directed to a reusable training munition having a reusable, single piece projectile that accurately reproduces the aerodynamic and mass properties of actual fielded projectiles for use as training munitions. Significant cost savings are achieved through a one piece, design while still maintaining the performance of the projectile. The projectile of the present invention closely simulates weight, flight stability and aerodynamic characteristics of an actual munition projectile, but utilizing materials and manufacturing techniques to reduce the cost and allow the projectile to be re-used numerous times without loss of performance during training exercises. The projectile of the present invention is a single-piece molded projectile having voids or cavities to simulate the mass properties of current non-lethal rounds.

DETAIL DESCRIPTION OF THE INVENTION

Figure 1:
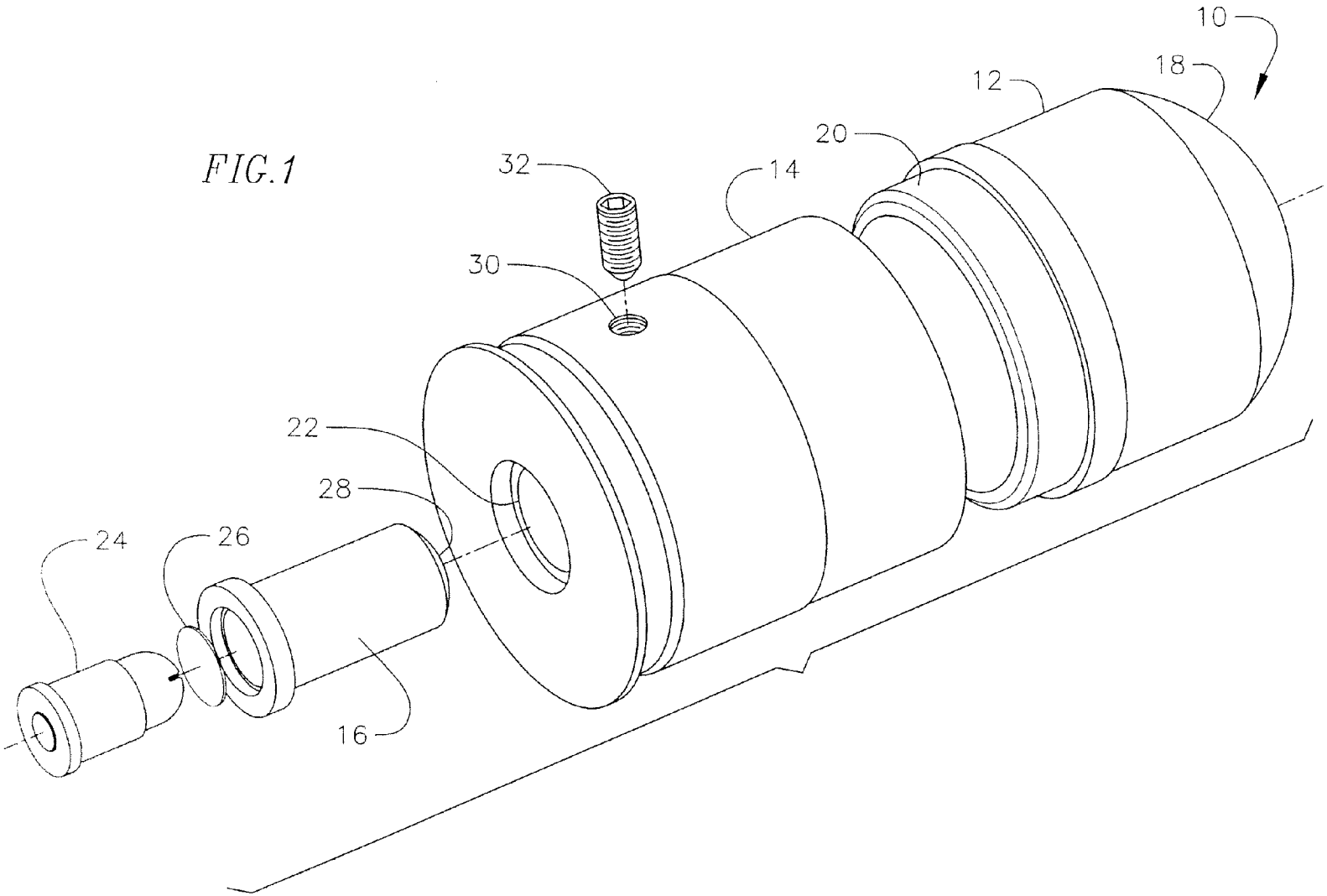
FIG. 1 is an exploded perspective view of a reloadable training munition of the present invention.

As shown in FIG. 1, a reloadable training munition 10 of the present invention is illustrated. The munition 10 comprises three main components, namely a reusable projectile 12, a reusable shell base 14 and a reload insert 16. The reusable projectile 12 has a nose component 18 which is designed to closely simulate the weight, flight stability and aerodynamic characteristics of an actual munitions projectile, but utilizing materials and manufacturing techniques to reduce the cost and allow the projectile to be reused numerous times without loss of performance. For example, an actual munition projectile could be a multi-component projectile made of plastic and foam components bonded together and the reusable projectile which would replace the actual projectile would be a single-piece, molded plastic projectile, the specifics of which will be discussed subsequently herein. The reusable projectile has a reduced diameter neck portion 20 sized to provide an interference fit inside the reusable shell base 14 and can be inserted into the shell base by hand.

The reusable shell base 14 has the same internal and external dimensions as a single use shell base to preserve the interface and fit with the projectile and the weapon platform. The reusable shell base incorporates a hollow cavity 22 in the bottom of the shell which accepts the reload insert 16. The internal diameter of the hollow cavity is designed with sufficient tolerance to allow the reload insert to be loaded or removed by hand. The reload insert 16 houses a blank cartridge 24 and a rupture disk 26. The reload insert also has a vent hole 28 as seen best in FIG. 2 which together with the propellant cartridge and rupture disk form a high/low pressure propulsion system.

To retain the reload insert within the reusable shell base, a mechanical attachment means is incorporated. For example, a threaded hole 30 extends from the external surface of the shell to the longitudinal axis of the shell and intersecting the hollow cavity 22. A set screw 32 is threaded into the hole and can be tightened to move the screw towards the hollow cavity and engage the reload insert. Consequently, when a reload insert is in place in the hollow cavity and the set screw tightened, the set screw provides a mechanical means of securing the reload insert into the reusable shell base. When the set screw is loosened, the reload insert can be easily removed by hand with simple hand tools such as an Allen wrench.

Figure 2:
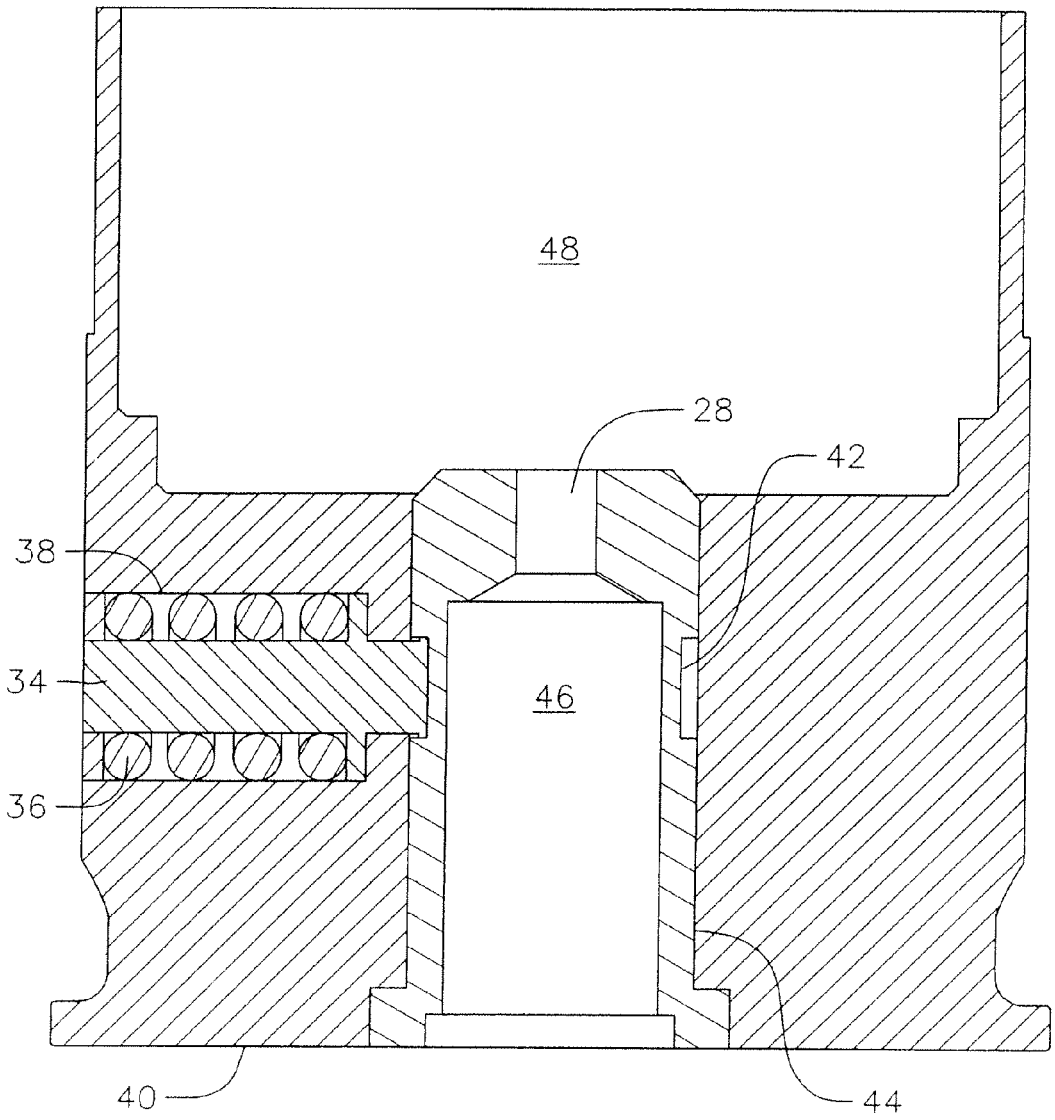
FIG. 2 is a cross-sectional view of an alternative reusable shell base and reload insert of the present invention.

As shown in FIG. 2, other forms of mechanical retention systems can be utilized such as a spring loaded locking pin 34.

Locking pin 34 includes a spring 36 which is positioned within a hole 38 extending into the shell base 40. The end of the pin 34 engages a groove 42 extending around the perimeter of the reload insert 44. When inserting the reload insert, the pin would be displaced out of the hollow cavity by compressing the spring and then returning it to the hollow cavity by spring force when the hole or groove and the external surface of the reload insert is aligned with the end of the pin. Other embodiments of mechanical retention systems could include a lock wire or retaining ring that is placed in one end of the hollow cavity to secure the reload insert while maintaining the ease of loading and unloading. Another example could be the reload insert itself could be threaded on its external surface to match threads on the interior surface of the hollow cavity, providing a means to screw the reload insert in and out of the shell base using common tools.

Another mechanical means of retention could be designed into the interface between the reload insert and the shell base such as steps or grooves that could lock the reload insert in place when it is inserted and turned in the shell base. A locking groove system would incorporate a reload with features that are keyed to the same pattern as the opening of the shell base, the keyed feature is positioned axially on the reload to align with a radial groove on the interior of the shell cavity. The reload is inserted until the keyed feature and the groove align, and then rotated to lock the reload in place. Still another mechanical means of retaining the propulsion system reload can be an O-ring interface between the propulsion system reload and the interior surface of the hollow cavity and the shell base. The O-ring could be located either in a groove on the external surface of the propulsion system reload, meeting with the groove on the internal surface of the hollow cavity in the shell base, or vice versa, wherein the O-ring is located in a groove on the internal surface of the hollow cavity of the shell base and mates with a groove on the surface of the propulsion system reload.

FIG. 2 also illustrates the principles of the high/low pressure propulsion system for the reload insert. The reload insert includes the vent hole 28 which separates the high pressure chamber 46 from the low pressure chamber 48. The munition shown in FIGS. 1 and 2 is, by way of example, a 40 MM reloadable training munition for non-lethal impact munitions, but other calibers of training munition applications are contemplated by the present invention.

Figure 3:
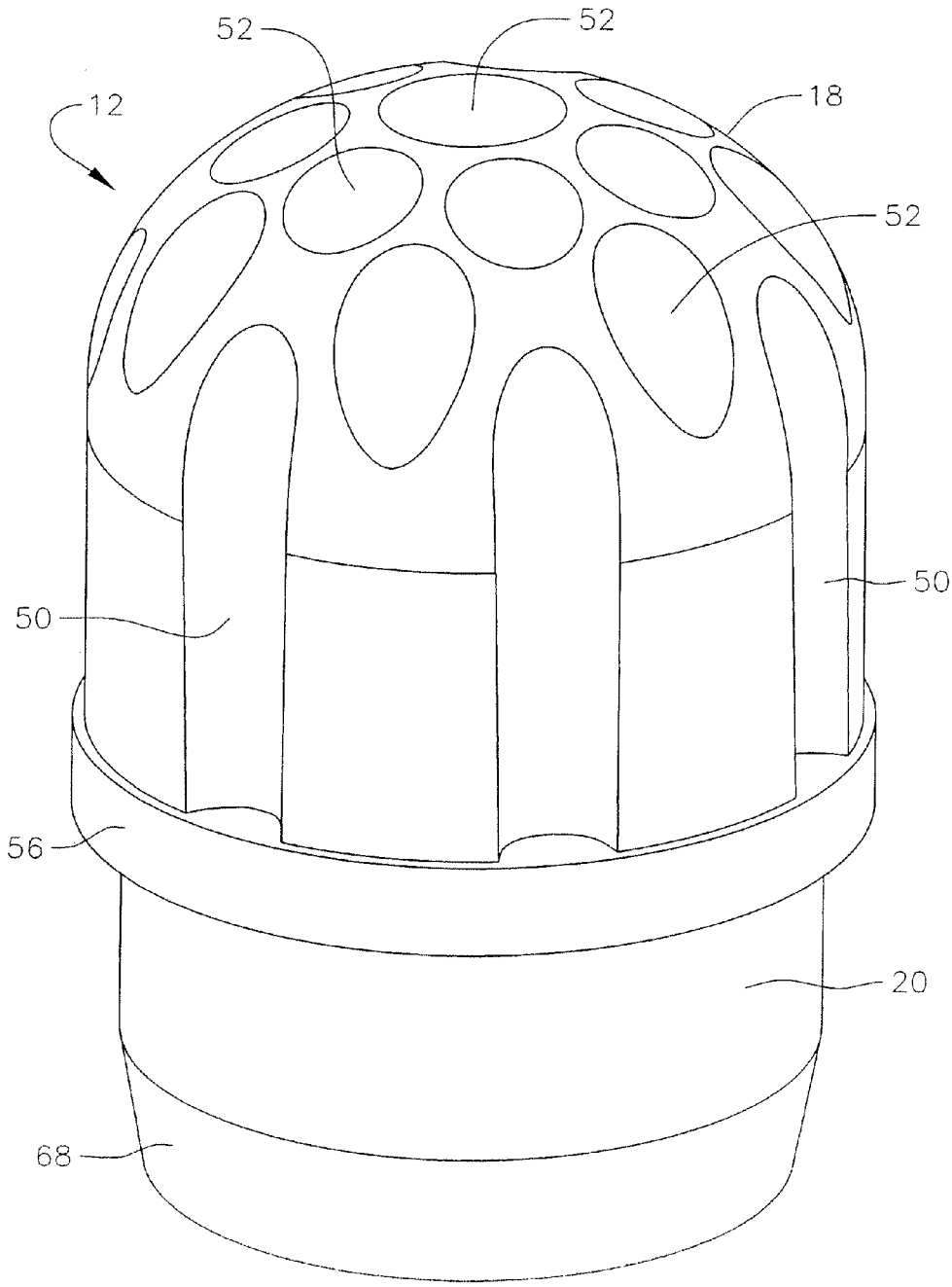
FIG. 3 is a perspective view of a single piece projectile of the reloadable training munition of FIG. 1.
Figure 4:
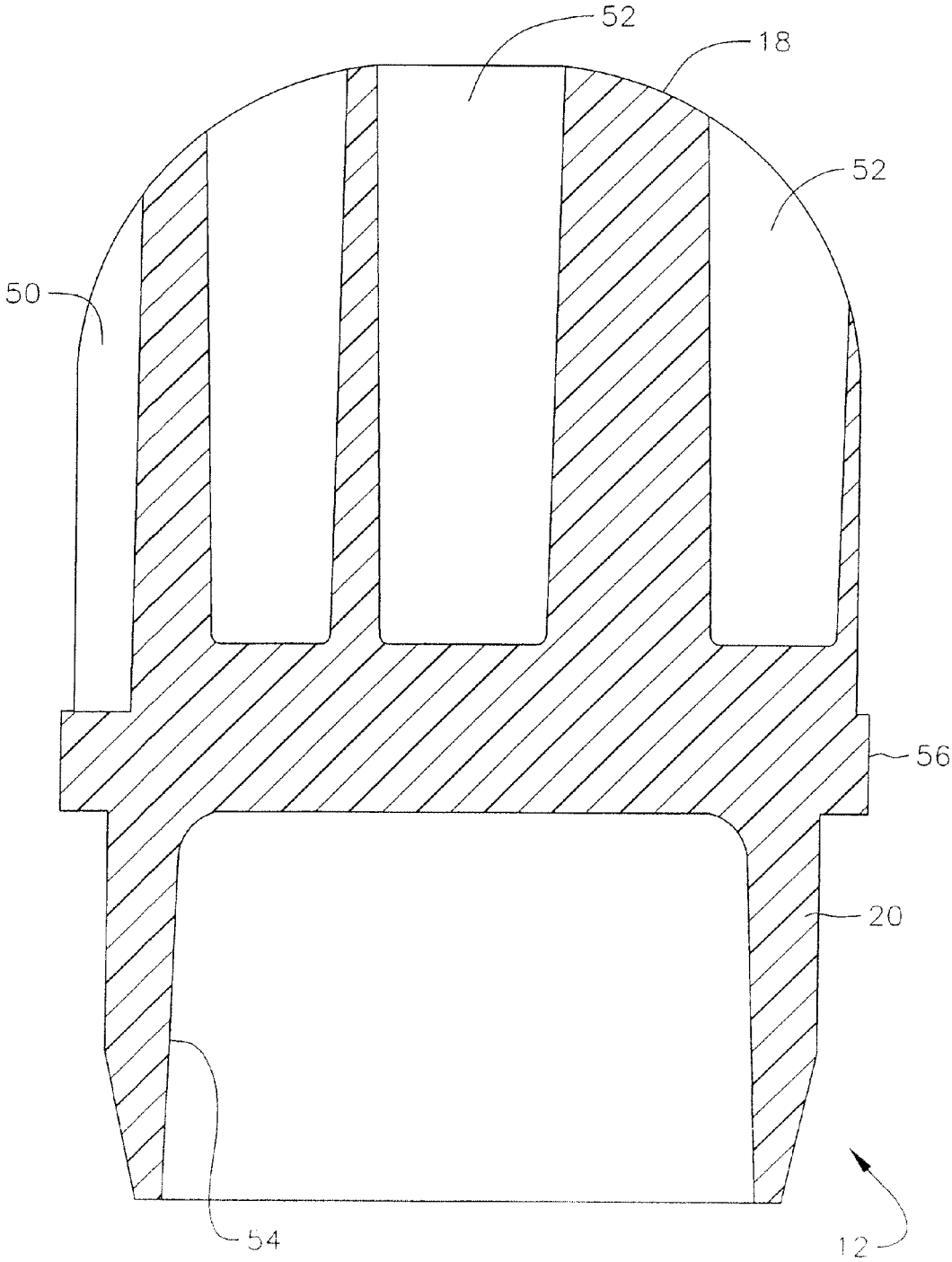
FIG. 4 is a cross-sectional view of the projectile of FIG. 3.

Referring now to FIGS. 3 and 4, the projectile 12 of the training munition 10 of the present invention is illustrated and is designed to closely simulate the weight, flight stability and aerodynamic characteristics of an actual munition projectile. The projectile 12 includes a plurality of void spaces 50 and cavities 52 to simulate mass properties of an actual munition. The projectile 12 is a single piece projectile molded out of a high-impact polymer to withstand repeated firings and impacts with hard surfaces without shattering. The base portion 20 of the projectile is designed to interface with munition shell base 14, and is generally hollow by including a cavity 54 to maximize the gyroscopic stability of the projectile. A driving band 56 is located on the outside diameter of the projectile base, which engages barrel rifling to impart spin to the projectile as it travels down the rifle bore. The nose 18 of the projectile has an outer contour similar to the contour of the actual round it simulates, so that the location of the center of pressure will remain approximately the same. To match the axial and transverse moments of inertia of the training projectile with those of the actual non-lethal projectile, the void spaces 50 and cavities 52 are incorporated to control mass properties of the projectile.

Figure 5:
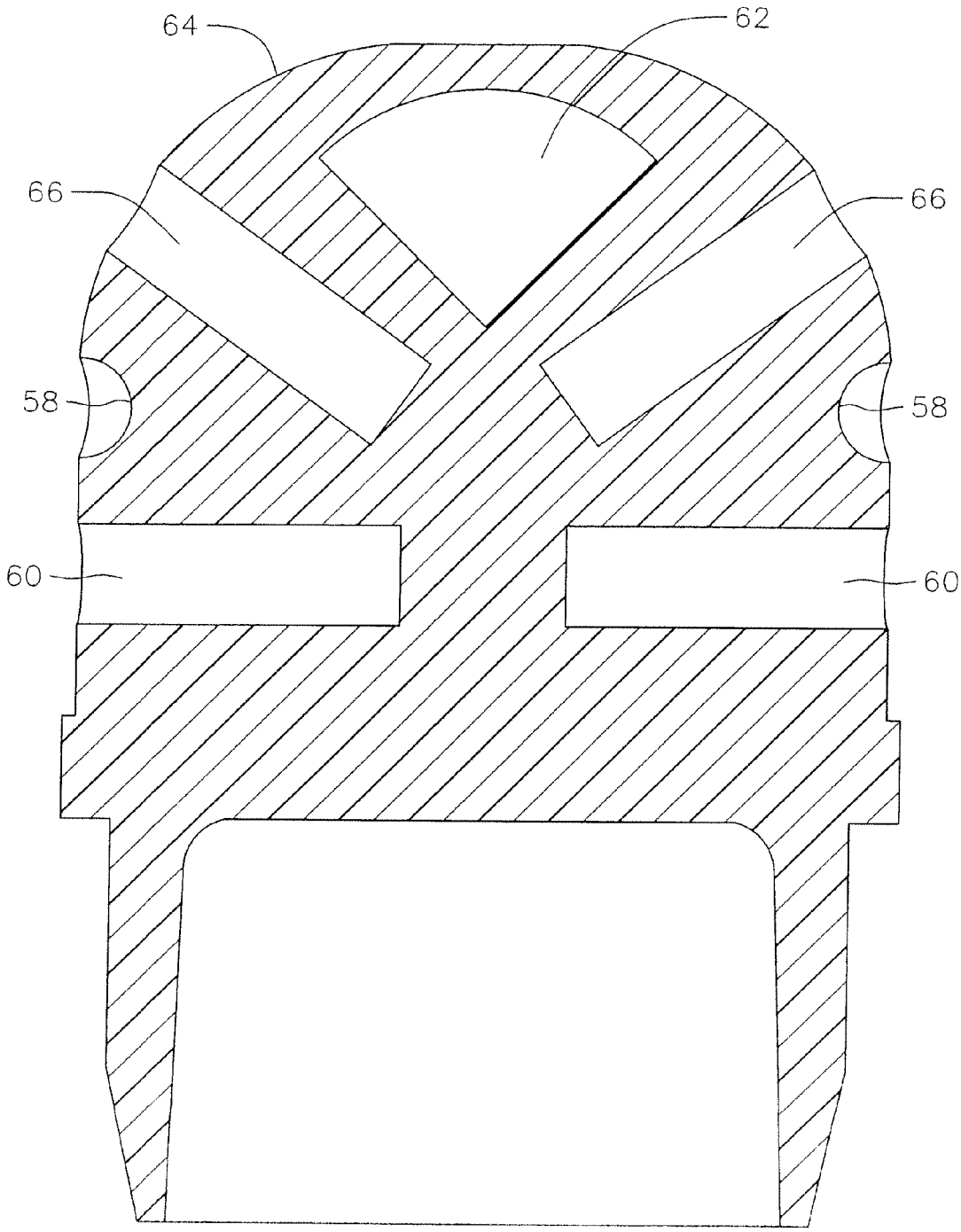
FIG. 5 is a cross-sectional view of an alternative projectile configuration of the present invention.

As shown in FIGS. 1 and 2, the void spaces and cavities are cylindrically shaped and are aligned parallel to the projectile longitudinal axis of rotation. The void spaces and cavities have the effect of decreasing the average density of the projectile nose, while approximately matching the center of gravity and moment of inertia of the actual projectile nose. Other void spaces could be incorporated into the projectile, that would produce the same result. Shown in FIG. 5 other void spaces could include radial grooves 58 or radial void spaces 60, an undercut void 62 under the forward nose surface 64, or a series of cylindrical cavities 66 placed at an angle to the longitudinal axis of rotation.

An additional advantage of the embodiment of the present invention involves the airflow into the cylindrical voids and cavities that are positioned parallel to the longitudinal axis of rotation as they produce stagnation areas on the spinning projectile, allowing generation of a turbulent boundary layer along the surface of the projectile nose. This turbulent layer is similar to that produced by dimples on the surface of a golf ball, and the drag reduction translates into less velocity drop over the flight trajectory. The projectile also includes an angled end surface 68 to increase stability of the projectile, the angled surface 68 being located on the end of the neck portion 20.

Although the present invention has been illustrated with respect to several embodiments therefore, it is not to be so limited since changes and modifications can be made which are within the intended scope of the invention as hereinafter claimed

What is claimed is:

1. A reloadable munition comprising:

a reusable shell base having a hollow cavity on a bottom face;

a reusable projectile that can be inserted into an end of the reusable shell base opposite from the hollow cavity, the projectile having a nose portion that is made from a high impact material that will withstand repeated firings and impacts without shattering, the projectile having at least one void space on a surface of the nose portion or extending into the nose portion of the projectile;

a propulsion system reload inserted into the hollow cavity of the shell base; and means for mechanically retaining the propulsion system reload in the shell base for loading and firing of the munition.

2. The munition of claim 1 wherein the propulsion system reload is a high/low pressure propulsion system having a propellant charge, a primer, a rupture disk and a vent hole separating a high pressure chamber from a low pressure chamber in the shell base.

3. The munition of claim 1 wherein the mechanical means of retaining the propulsion system reload is a set screw that is threaded into a hole and a side of the shell base running perpendicular to a longitudinal axis of the shell base.

4. The munition of claim 1 wherein the projectile has a plurality of void spaces on a surface of the projectile around a nose portion of the projectile.

5. The munition of claim 4 wherein the void spaces extend parallel to a longitudinal axis of rotation of the projectile.

6. The munition of claim 4 wherein the void spaces are perpendicular to a longitudinal axis of rotation.

7. The munition of claim 1 wherein the projectile has a plurality of void spaces extending into the projectile in a nose portion of the projectile.

8. The munition of claim 7 wherein the void spaces extend into the nose portion at an angle to a longitudinal axis of rotation.

9. The munition of claim 1 wherein the projectile has a driving band positioned between a nose portion and a body portion.

10. The munition of claim 1 wherein the projectile has a body portion having a hollow cavity extending from an end surface and an angled exterior surface adjacent the end surface to increase stability of the projectile.

* * * * *